US011759063B2

(12) United States Patent
Flores

(10) Patent No.: US 11,759,063 B2
(45) Date of Patent: Sep. 19, 2023

(54) MULTIPURPOSE FOLDING CHAIR

(71) Applicant: Marcelo Flores, Encinal, TX (US)

(72) Inventor: Marcelo Flores, Encinal, TX (US)

( * ) Notice: Subject to any disclaimer, the term of this patent is extended or adjusted under 35 U.S.C. 154(b) by 0 days.

(21) Appl. No.: 17/707,640

(22) Filed: Mar. 29, 2022

(65) Prior Publication Data

US 2022/0304525 A1 Sep. 29, 2022

Related U.S. Application Data

(60) Provisional application No. 63/167,571, filed on Mar. 29, 2021.

(51) Int. Cl.
*A47K 11/04* (2006.01)

(52) U.S. Cl.
CPC ..... *A47K 11/04* (2013.01)

(58) Field of Classification Search
CPC ..... A47K 11/04
USPC ..... 4/483
See application file for complete search history.

(56) References Cited

U.S. PATENT DOCUMENTS

| | | | | |
|---|---|---|---|---|
| 223,574 | A * | 1/1880 | Baker | |
| 780,007 | A * | 1/1905 | Mettler | |
| 1,428,627 | A | 9/1922 | Grabfelder | |
| 1,521,740 | A | 6/1923 | Wernli et al. | |
| 3,105,665 | A * | 10/1963 | Starkweather | A47D 3/005 248/101 |
| 6,009,571 | A | 1/2000 | Battiston et al. | |
| 6,378,142 | B1 | 4/2002 | Gray | |
| 6,389,612 | B1 | 5/2002 | Harris | |
| 6,889,393 | B1 | 5/2005 | Rinaldo | |
| 7,260,855 | B2 * | 8/2007 | Aycock | A47K 11/02 4/484 |
| 7,857,380 | B2 | 12/2010 | Grieger et al. | |
| 8,893,316 | B1 | 11/2014 | Smith | |
| 9,498,097 | B2 | 11/2016 | Grant | |
| 9,591,924 | B1 | 3/2017 | O'Neal | |
| 10,080,440 | B2 | 9/2018 | Nelson | |
| 10,213,071 | B2 | 2/2019 | Tao | |
| 2005/0039250 | A1 | 2/2005 | Krause | |
| 2005/0215886 | A1 | 6/2005 | Kong | |
| 2006/0169310 | A1 | 8/2006 | Qian et al. | |
| 2015/0082526 | A1 | 3/2015 | Grudzinski | |

FOREIGN PATENT DOCUMENTS

| | | | |
|---|---|---|---|
| GB | 2317332 | A | 3/1998 |

* cited by examiner

*Primary Examiner* — Huyen D Le
(74) *Attorney, Agent, or Firm* — Outlier Patent Attorneys, PLLC

(57) ABSTRACT

A multipurpose portable chair includes a seating portion pivotably coupled to front legs and back legs. The seating portion includes a base portion having a frame and an opening in the middle of the frame. A retaining ring for holding a waste receptacle is disposed within the opening in the base portion. A toilet seat is coupled to the base portion and configured to cover the retaining ring. A lid is coupled to the base portion and configured to cover the toilet seat. A user may sit on top of the lid when the chair is to be used as a sitting surface, or the user may lift the lid and sit on the toilet seat when the chair is to be used as a restroom facility or refuse container. The parts of the multipurpose portable chair are removably coupled together so that it is easy to remove and replace individual parts.

13 Claims, 10 Drawing Sheets

MULTIPURPOSE FOLDING CHAIR

CROSS-REFERENCE TO RELATED APPLICATIONS

This application claims priority to U.S. Provisional Patent Application Ser. No. 63/167,571, filed Mar. 29, 2021, entitled "MULTIPURPOSE FOLDING CHAIR," the entire contents of which are incorporated herein by reference.

BACKGROUND

Field of the Art

This disclosure relates to a folding chair having multiple uses. In particular, this disclosure relates to a folding chair that is configured for use as a chair, but can also be used as a toilet chair or a waste receptacle.

Discussion of the State of the Art

Being in a remote location, such as during camping, fishing, hunting, or the like, poses challenges when one must relieve themselves. Without sanitation facilities nearby, using the bathroom may be difficult, challenging, and uncomfortable Similarly, getting to a bathroom facility may be difficult for disabled or bedridden individuals.

Currently available portable toilet chairs are not visually appealing and are not generally used for sitting purposes. Rather, currently available toilet chairs are only to be used as toilets.

Another problem with currently available portable toilet chairs is that if one part of the chair is damaged or broken, the entire chair is rendered unusable. The parts are not removable and replaceable.

As such, there is a need for a more aesthetically pleasing portable toilet chair that is easily collapsed, transported, repaired, and upgraded, and that can also be used as a chair.

SUMMARY

The apparatus of the present invention is a collapsible, portable, multipurpose chair that has a seating surface configured to cover a toilet seat and/or a holder for a refuse container. As such, the multipurpose chair can be used as a place to sit or can be used as a toilet chair or waste receptacle.

The apparatus of the present invention further includes a retaining ring for holding a waste receptacle, such as a trash bag, bucket, or the like. The retaining ring is concealed under the toilet seat and within a base portion of the seating portion of the chair. By obstructing the toilet seat and the retaining ring, the multipurpose chair of the present invention is more aesthetically pleasing and more discreet than conventional portable toilet chairs.

The multipurpose folding chair includes front legs pivotably coupled to back legs. When the chair is in a collapsed configuration, the back legs and front legs are parallel and directly adjacent to each other. When the chair is in an open, ready-to-use configuration, the back legs and front legs are spaced apart and are at an acute angle relative to each other. The chair further includes a seating portion pivotably coupled to the back legs and the front legs. The seating portion is substantially horizontal and parallel to the ground when the chair is in the open configuration. The seating portion includes a base portion pivotably coupled to the back legs and the front legs. The base portion includes a frame and a through opening in a central portion of the frame. The seating portion further includes a lid hingedly coupled to the base portion such that the lid is configured to open relative to the base portion. The lid has a solid upper surface for a user to sit on. A toilet seat is hingedly coupled to the base portion such that the toilet seat is configured to hinge open relative to the base portion. The toilet seat has an aperture that is aligned with the through opening in the base portion. The lid covers the toilet seat. A retaining ring fits snugly within the through opening in the base portion and is configured to hold a waste receptable securely to the chair, such that waste that is disposed through the toilet seat aperture is captured in the waste receptacle.

One of the advantages of the multipurpose folding chair in accordance with the present invention is that the chair can be easily disassembled and reassembled, thereby making it easy to swap out parts of the chair as needed. For example, it may be desirable to change the toilet seat to another toilet seat made of different material or having cushioning. In another example, it may be desirable to swap the backrest for a different, higher-end backrest that includes a portable charging station. Further, when parts of the chair become damaged or break, the damaged or broken part can easily be replaced with a new part.

BRIEF DESCRIPTION OF THE DRAWING FIGURES

The accompanying drawings illustrate several embodiments and, together with the description, serve to explain the principles of the invention according to the embodiments. It will be appreciated by one skilled in the art that the particular arrangements illustrated in the drawings are merely exemplary and are not to be considered as limiting of the scope of the invention or the claims herein in any way.

DETAILED DESCRIPTION

Figure 1A:
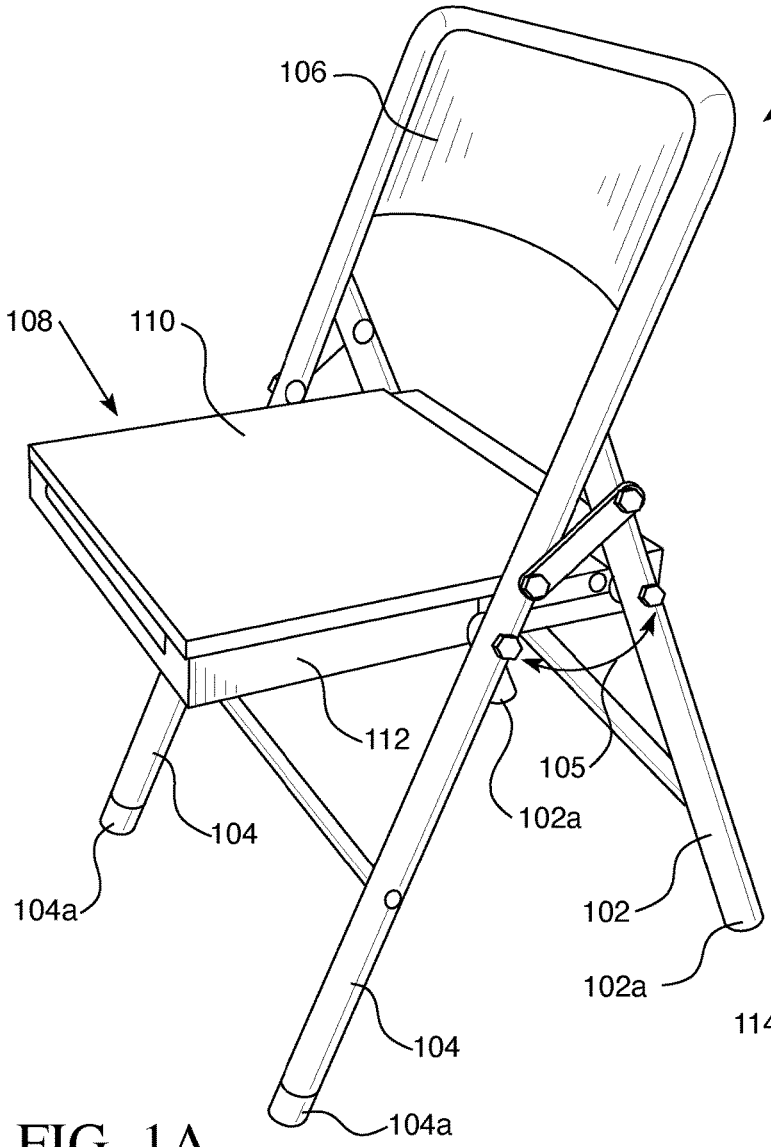
FIGS. 1A and 1B are perspective views of a multipurpose folding chair in an open configuration and a collapsed configuration, respectively, in accordance with one embodiment of the present invention.

The present invention is for a multipurpose folding chair that can be used for sitting on but can also be used as a toilet chair and/or a waste receptacle. A toilet seat and waste receptacle retaining ring are discreetly concealed within the seating portion of the chair. The seating portion of the chair includes a base portion having a frame and an opening in the middle thereof. The retaining ring is housed within the base portion. The toilet seat is coupled to the base portion via hinges. A lid is attached to the base portion and is configured to conceal the toilet seat. In this manner, a user may sit upon the lid when it is desirable to use the chair as simply a sitting surface, or a user can lift the lid when it is desirable to use the chair as a toilet.

The multipurpose chair includes many parts attached to each other. The multipurpose chair is easily disassembled and reassembled, making it easy to customize the chair or to replace parts that become broken or damaged. For example, the chair may be customized by replacing the toilet seat with a toilet seat made of a different material. In another example, it is easy to replace the backrest with an upgraded backrest, such as a backrest that includes a portable charging station, solar panel, or other similar luxury features.

The invention is described by reference to various elements herein. It should be noted, however, that although the various elements of the inventive apparatus are described separately below, the elements need not necessarily be separate. The various embodiment may be interconnected and may be cut out of a singular block or mold. The variety of different ways of forming an inventive apparatus, in accordance with the disclosure herein, may be varied without departing from the scope of the invention.

Generally, one or more different embodiments may be described in the present application. Further, for one or more of the embodiments described herein, numerous alternative arrangements may be described; it should be appreciated that these are presented for illustrative purposes only and are not limiting of the embodiments contained herein or the claims presented herein in any way. One or more of the arrangements may be widely applicable to numerous embodiments, as may be readily apparent from the disclosure. In general, arrangements are described in sufficient detail to enable those skilled in the art to practice one or more of the embodiments, and it should be appreciated that other arrangements may be utilized and that structural changes may be made without departing from the scope of the embodiments. Particular features of one or more of the embodiments described herein may be described with reference to one or more particular embodiments or figures that form a part of the present disclosure, and in which are shown, by way of illustration, specific arrangements of one or more of the aspects. It should be appreciated, however, that such features are not limited to usage in the one or more particular embodiments or figures with reference to which they are described. The present disclosure is neither a literal description of all arrangements of one or more of the embodiments nor a listing of features of one or more of the embodiments that must be present in all arrangements.

Headings of sections provided in this patent application and the title of this patent application are for convenience only and are not to be taken as limiting the disclosure in any way.

Devices and parts that are connected to each other need not be in continuous connection with each other, unless expressly specified otherwise. In addition, devices and parts that are connected with each other may be connected directly or indirectly through one or more connection means or intermediaries.

A description of an aspect with several components in connection with each other does not imply that all such components are required. To the contrary, a variety of optional components may be described to illustrate a wide variety of possible embodiments and in order to more fully illustrate one or more embodiments. Similarly, although process steps, method steps, or the like may be described in a sequential order, such processes and methods may generally be configured to work in alternate orders, unless specifically stated to the contrary. In other words, any sequence or order of steps that may be described in this patent application does not, in and of itself, indicate a requirement that the steps be performed in that order. The steps of described processes may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the embodiments, and does not imply that the illustrated process is preferred. Also, steps are generally described once per aspect, but this does not mean they must occur once, or that they may only occur once each time a process, or method is carried out or executed. Some steps may be omitted in some embodiments or some occurrences, or some steps may be executed more than once in a given aspect or occurrence.

When a single device or article is described herein, it will be readily apparent that more than one device or article may be used in place of a single device or article. Similarly, where more than one device or article is described herein, it will be readily apparent that a single device or article may be used in place of the more than one device or article.

The functionality or the features of a device may be alternatively embodied by one or more other devices that are not explicitly described as having such functionality or features. Thus, other embodiments need not include the device itself.

Techniques and mechanisms described or referenced herein will sometimes be described in singular form for clarity. However, it should be appreciated that particular embodiments may include multiple iterations of a technique or multiple instantiations of a mechanism unless noted otherwise. Alternate implementations are included within the scope of various embodiments in which, for example, functions may be executed out of order from that shown or discussed, including substantially concurrently or in reverse order, depending on the functionality involved, as would be understood by those having ordinary skill in the art.

Overview

The apparatus of the present invention is a chair having a seating surface, a toilet seat, a retaining ring for holding a waste receptacle, and a base having an opening therein through which the waste receptacle may protrude. The chair is easily foldable for storage and portability. As such, the chair can advantageously be used in remote locations where sanitation facilities and/or garbage cans are not available or inaccessible. For example, the chair may be used while camping, hunting, fishing, or the like. A user may sit upon the seating surface of the chair, or may lift the seating surface to reveal a toilet seat and/or a waste receptacle.

Apparatus

Figure 1B:
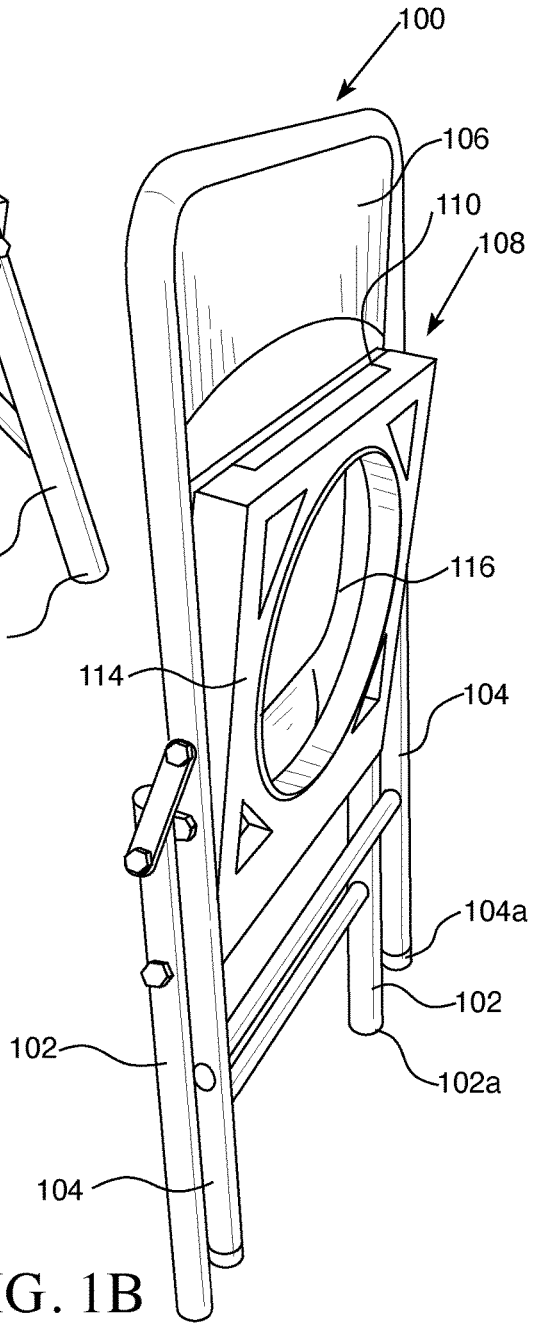

FIGS. 1A and 1B illustrate the inventive apparatus 100 in accordance with an embodiment of the invention. In particular, FIGS. 1A and 1B illustrate a multi-purpose folding chair 100 having back legs 102 pivotably coupled to front legs 104, similar to a conventional folding chair. The front legs 104 are attached to a back rest portion 106. The front legs 104 and the back rest portion 106 may be manufactured as a unitary piece that is pivotably coupled to the back legs 102. The chair 100 further includes a seat portion 108 pivotably coupled to the back legs 102 and the front legs 104. The parts of the seat portion 108 may be provided in a kit that may be used to modify a conventional folding chair, as discussed in more detail below.

All of the parts of the chair 100 are made of strong, rigid, lightweight, anti-corrosive materials. For example, the parts of the chair 100 may be made of plastic, wood, certain metals, or the like, and/or combinations of these materials. All of the parts of the chair 100 are removably coupled together with screws or bolts, and the chair is easily disassembled and reassembled. As such, replacing parts of the chair 100 is simple.

FIG. 1A depicts the chair 100 in an open, ready-to-use configuration, while FIG. 1B depicts the chair 100 in a folded, or collapsed, configuration. In the collapsed configuration, shown in FIG. 1B, the front legs 104, rear legs 102, and seat portion 108 are substantially parallel and directly adjacent to each other. With the back feet 102*a* resting on the ground, the front legs 104, back legs 102, and seat portion 108 are substantially vertical and perpendicular to the ground when the chair 100 is in the folded position. The chair 100 may be easily stored or transported in the collapsed configuration. The front legs 104, back legs 102, and seat portion 108 are pivotably coupled to each other so that the chair 100 can easily be moved from the folded to the opened configuration and from the opened to the folded configuration. In the open, ready-to-use configuration, shown in FIG. 1A, the feet 104*a* of the front legs 104 are spaced apart from the feet 102*a* of the back legs 102, and the front legs 104 are at an acute angle 105 relative to the back legs 102. In the open position, the seat portion 108 of the chair 100 is horizontal and is substantially parallel to the ground.

As depicted in FIGS. 1A and 1B, the seat portion 108 of the chair 100 includes a lid 110 coupled to a base portion 112 in a manner that allows the lid 110 to open relative to the base portion 112. For example, the lid 110 may be coupled to the base portion 112 with an elongated, partially threaded bolt so that the lid 110 may rotate relative to the bolt in order to open relative to the base portion 112. The pivot point of the lid 110 is preferably positioned in the rear of the seating portion 108. That is, when the chair 100 is in the open configuration, the pivot point is directly below the back rest 106. When the lid 110 is down, the chair 100 appears to be a conventional folding chair and a user may sit upon the lid 110. The lid 110 thus includes a solid upper surface made of a sufficiently rigid, strong material capable of supporting the weight of a person sitting thereupon. As shown in FIG. 1B, the base portion 112 includes a frame 114 surrounding a through opening 116.

Figure 2:
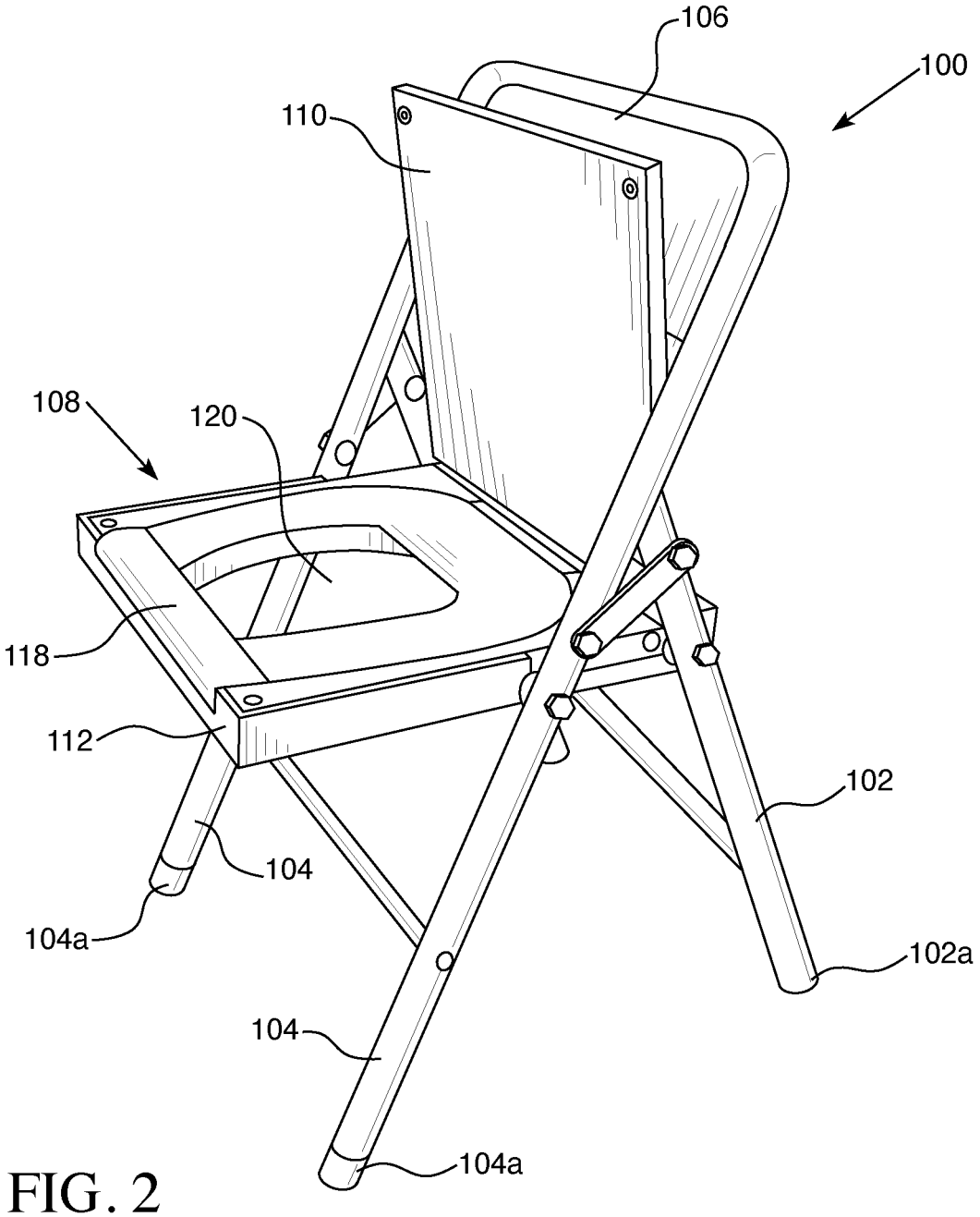
FIG. 2 is a perspective view of the multipurpose folding chair with the lid lifted, in accordance with one embodiment of the present invention.

As shown in FIG. 2, when the lid 110 is lifted, a toilet seat 118 is revealed. The toilet seat 118 may also be coupled to the base portion 112 via an elongated, partially threaded bolt, so that the toilet seat 118 may be lifted relative to the base portion 112. Similar to the lid 110, the bolt attaching the toilet seat 118 to the base portion 112 is preferably in the rear of the seating portion 108 so that the toilet seat 118 lifts towards the back rest 106. The toilet seat 118 surrounds an opening 120. The toilet seat 118 is made of a rigid material configured to support a user sitting on the top surface thereof. For example, the toilet seat 118 may be made of plastic, wood, metal, or the like. A top surface of the toilet seat 118, which is the surface of the toilet seat 118 that directly contacts the user during use, may be padded with foam, gel, or the like. Further, the toilet seat 118 may be easily removed and replaced with another toilet seat 118. For example, if the toilet seat 118 becomes damaged, or if the user wishes to replace it with another toilet seat 118 comprising a different material, swapping out the current toilet seat 118 with a new toilet seat can easily be accomplished. The opening 120 in the toilet seat 118 may be substantially circular, oval, elliptical, or the like. The opening 120 is aligned with the opening 116 in the base portion 112.

Figure 3:
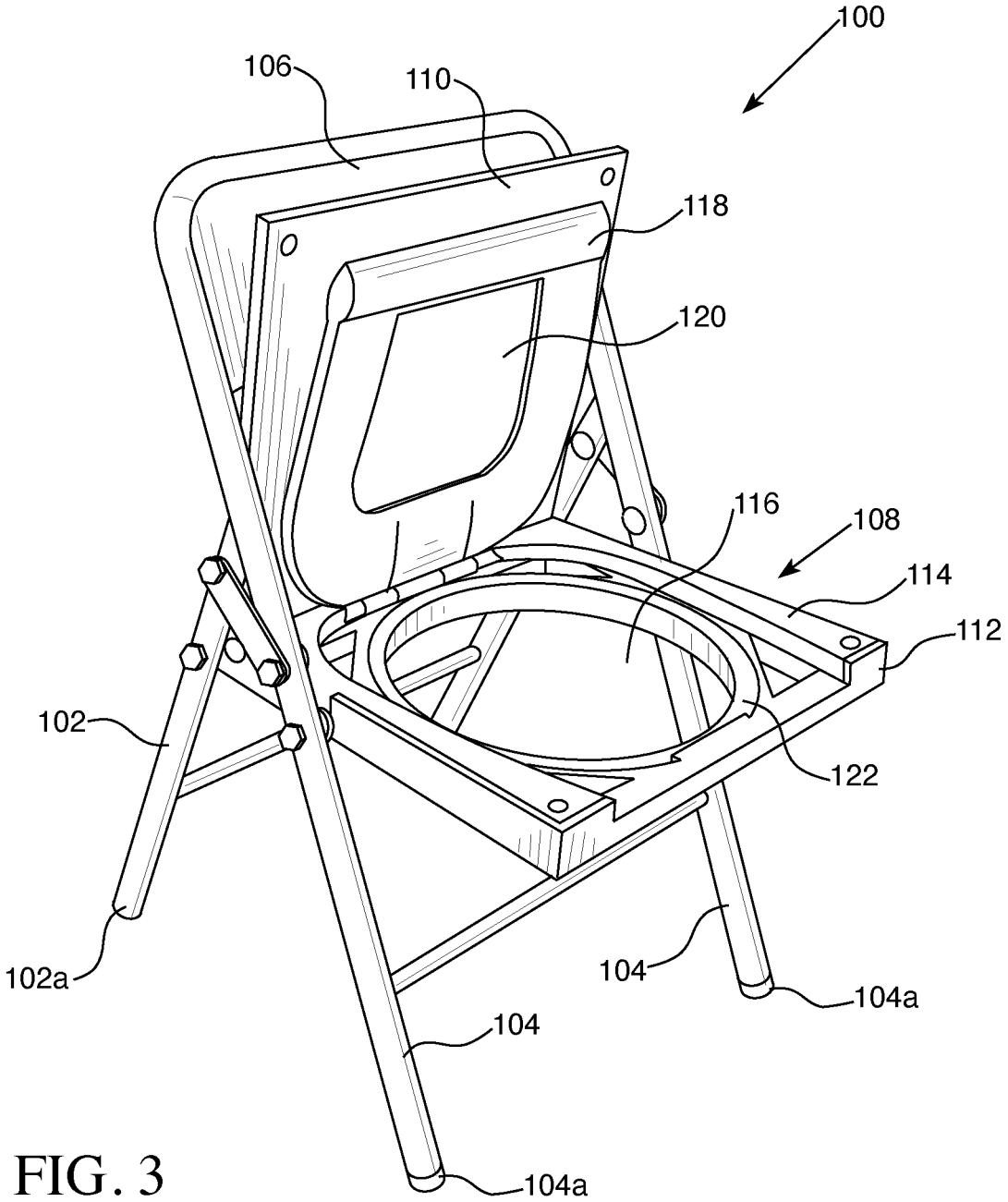
FIG. 3 is a perspective view of the multipurpose folding chair with the lid and toilet seat lifted, in accordance with one embodiment of the present invention.

As shown in FIG. 3, when the toilet seat 118 is lifted, a retaining ring 122 is revealed. The retaining ring 122 is configured to hold a waste receptacle, such as a trash bag, bucket, or the like. The retaining ring 122 fits snugly within the opening 116 in the base portion 112.

Figure 4:
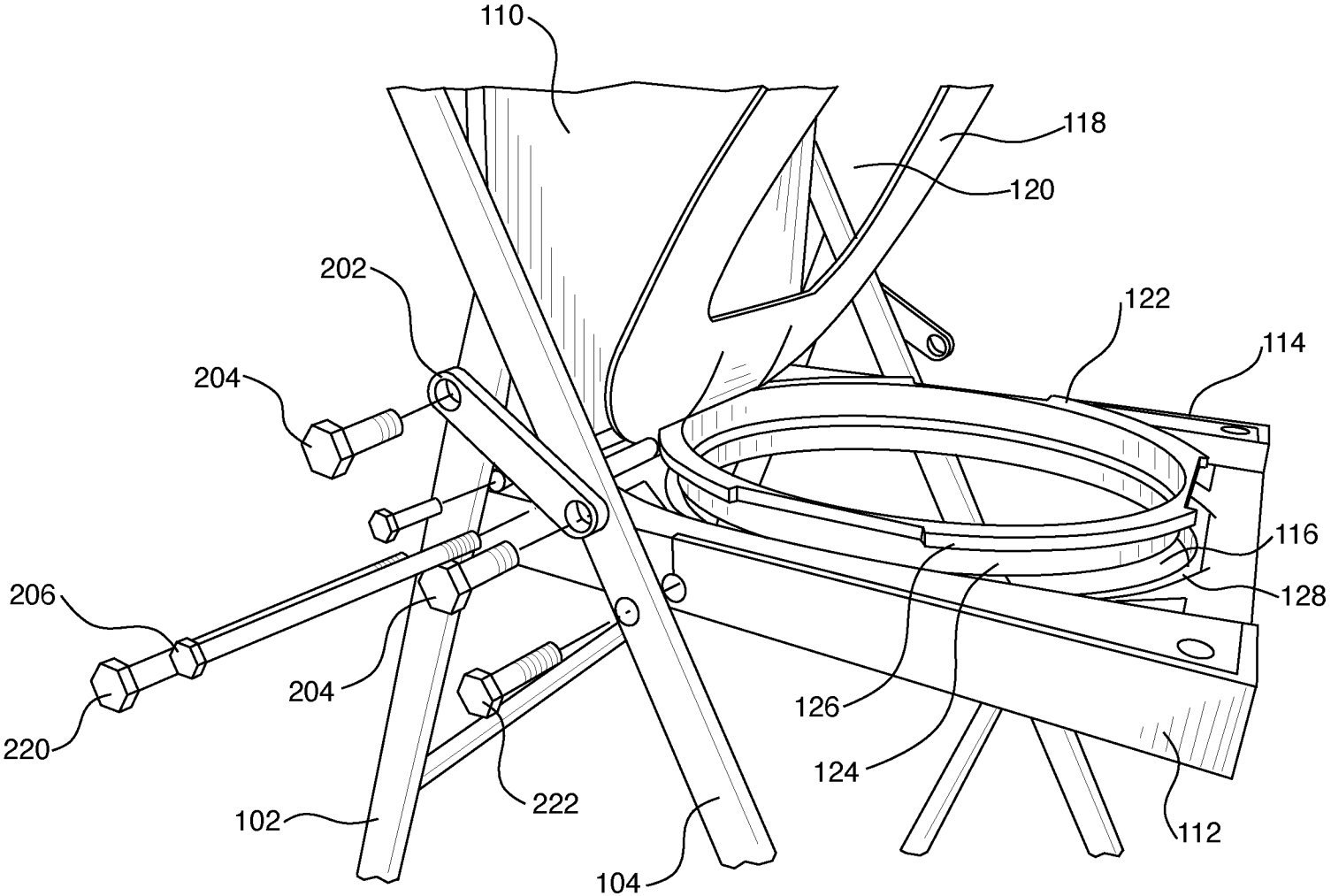
FIG. 4 is a close-up view of a retaining ring that is part of the seating portion of the multipurpose folding chair, in accordance with one embodiment of the present invention.

The retaining ring 122 is illustrated in more detail with reference to FIG. 4. The retaining ring 122 in this embodiment includes a downwardly protruding portion 124 and a circumferential lip 126 extending substantially perpendicularly outwards relative to the downwardly protruding portion 124. The downwardly protruding portion 124 has an outer diameter that is slightly smaller than the inner diameter of the opening 116 in the base portion 112. As such, the downwardly protruding portion 124 extends into the opening 116 in the base portion 112. The circumferential lip 126 of the retaining ring 122 rests on a ledge 128 in the opening 116 in the base portion 112.

Figure 5A:
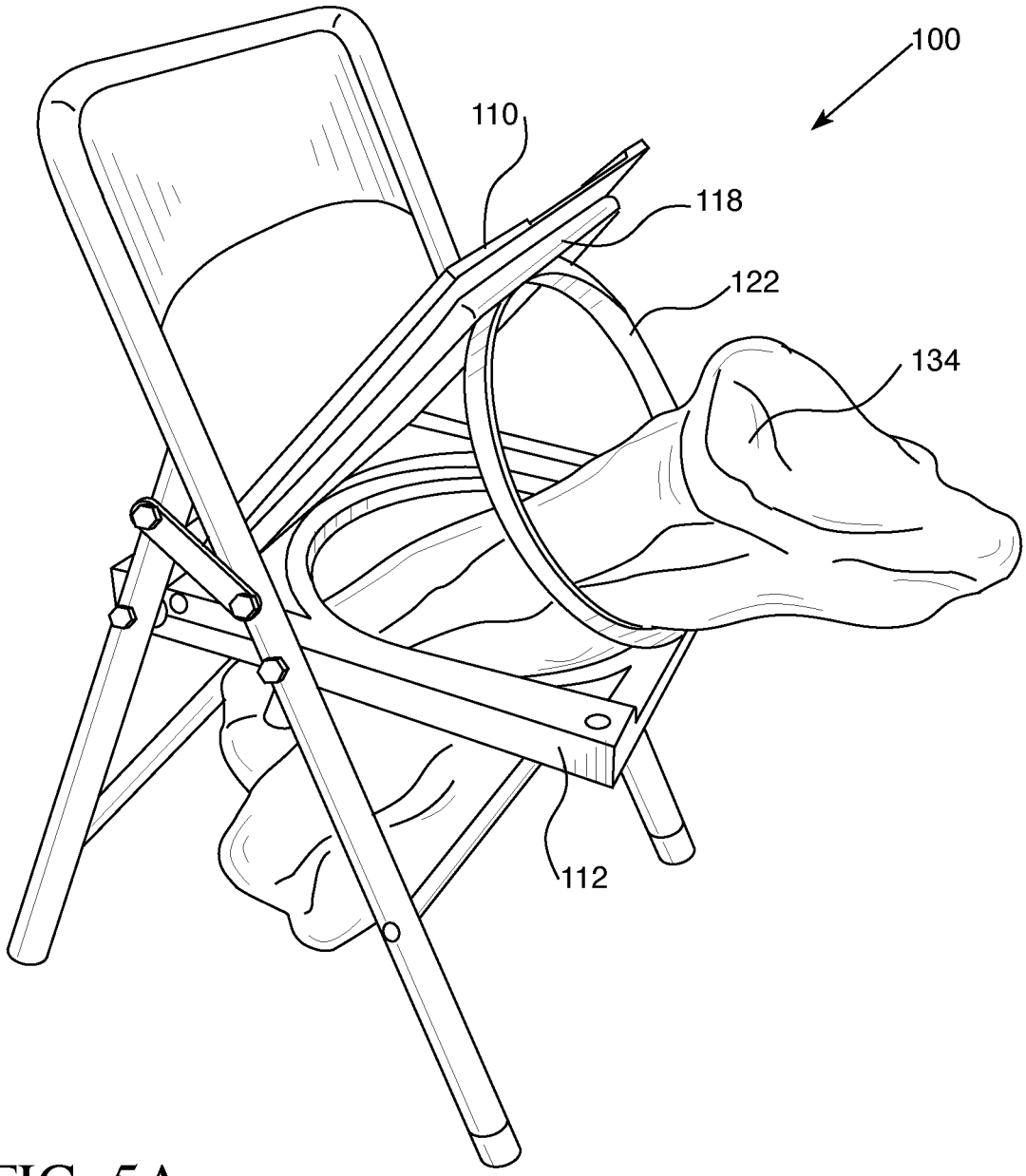
FIGS. 5A-5C illustrate the steps for attaching a waste receptacle to the multipurpose folding chair.
Figure 5B:
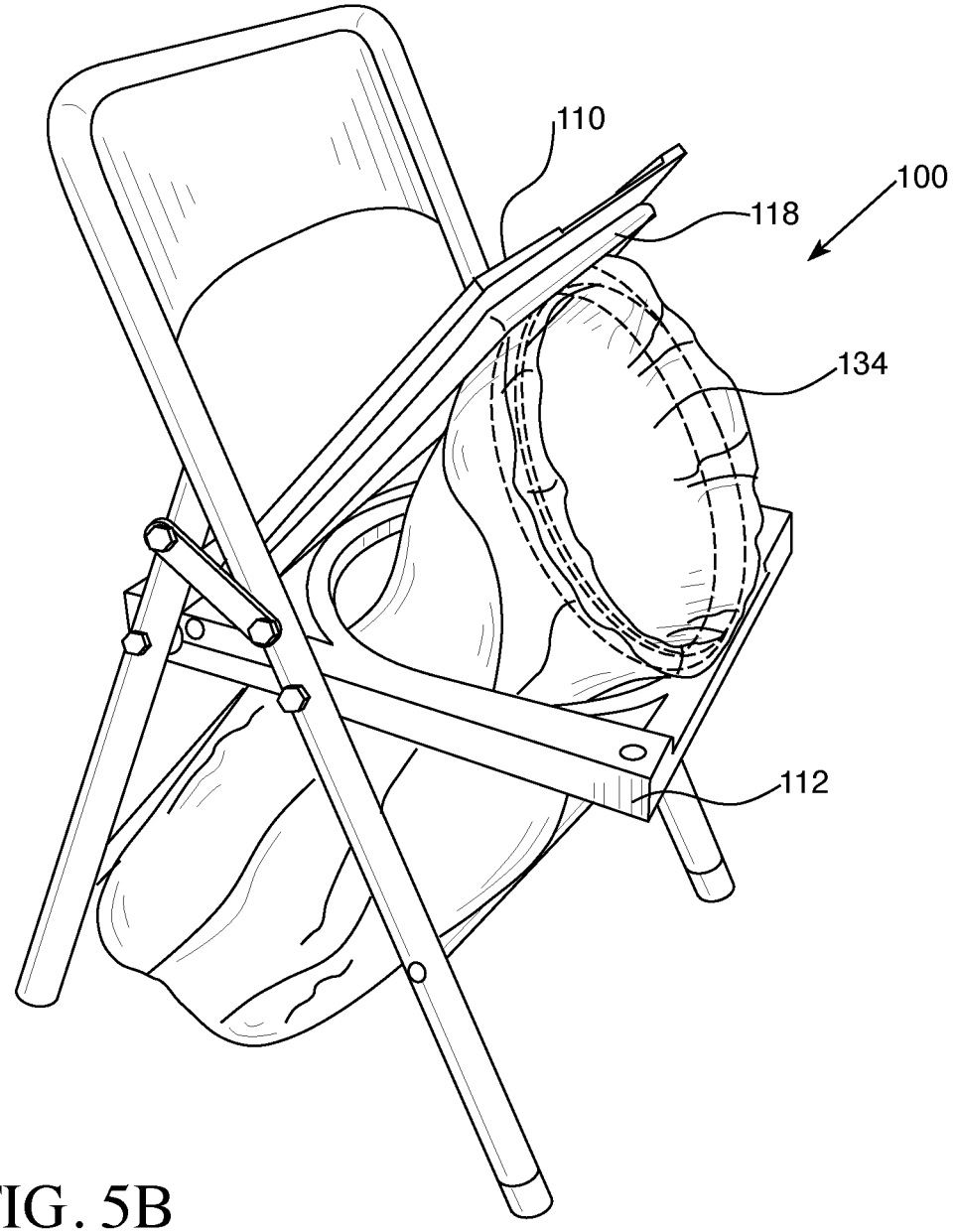
Figure 5C:
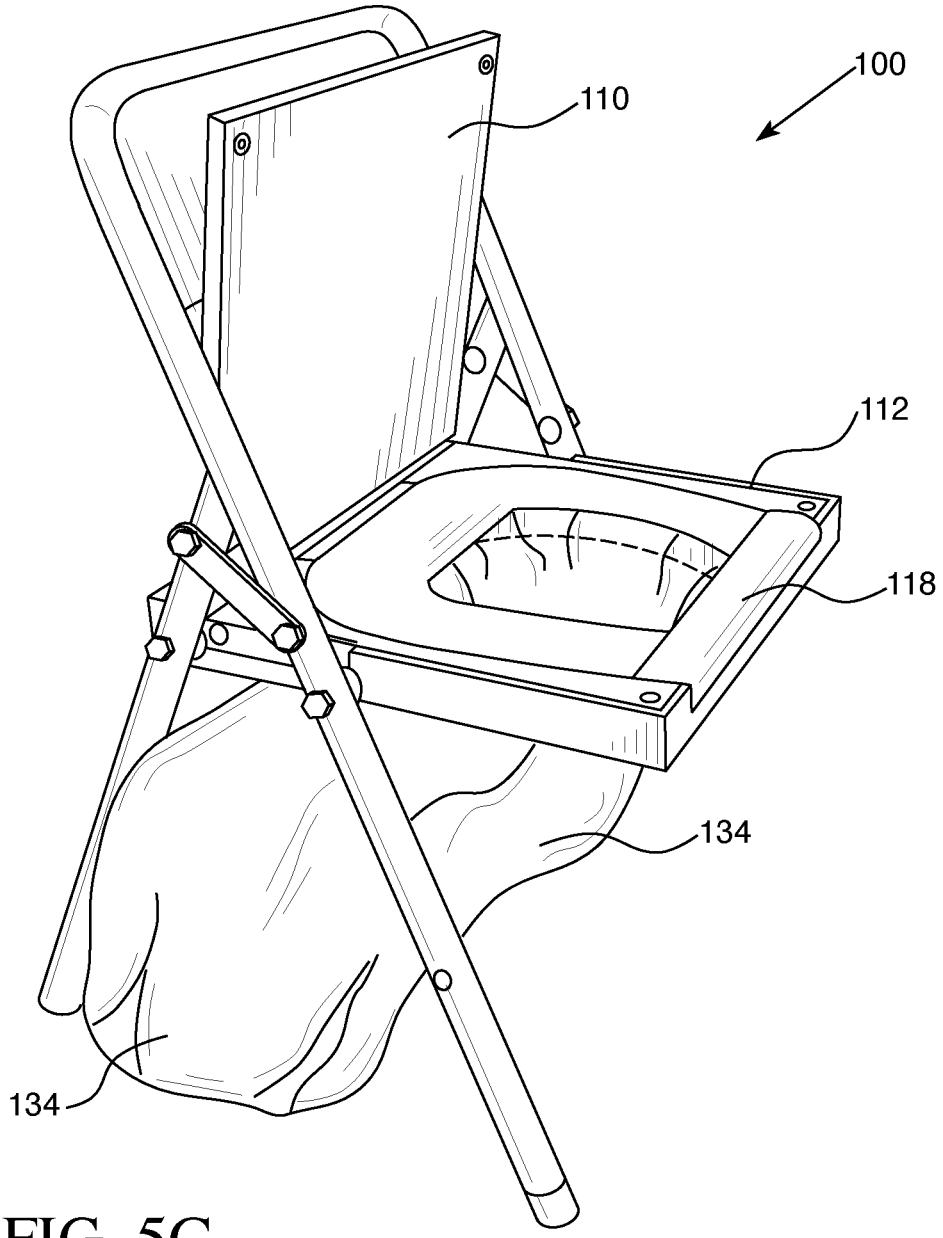

As shown in FIGS. 5A-5C, a waste receptacle may be held in place relative to the chair 100 using the retaining ring 122. The waste receptacle may be a bag, bucket, or the like, and may be used to hold human waste or other trash that may be deposited through the opening 120 in the toilet seat 118. FIG. 5A depicts a plastic bag 134 disposed through the middle of the retaining ring 122. Next, as shown in FIG. 5B, the top portion of the plastic bag 134 is folded over the retaining ring 122 so that the bottom, closed portion of the plastic bag 134 extends through the middle of the retaining ring 122, while the top, open portion of the plastic bag 134 is in contact with, and wrapped around, the outer edges of the retaining ring 122. Finally, as shown in FIG. 5C, the retaining ring 122 with the plastic bag 134 attached thereto is securely disposed in the opening 116 in the base portion 112, and the toilet seat 118 is lowered to secure the retaining ring 122 and plastic bag 134 in place. In this manner, the plastic bag 134 is securely attached to the chair 100 and cannot be removed from the chair 100 unless the lid 110 and the toilet seat 118 are lifted to provide access to the retaining ring 122. That is, the retaining ring 122 is hidden under the toilet seat 118 and within the base portion 112.

With conventional portable toilet chairs, when a part of the chair becomes damaged or broken, the entire chair is rendered useless. In contrast, all of the parts of the chair 100 of the present invention are removably coupled to each other and can easily be replaced. As such, the chair 100 is easily repaired. All of the parts, including the back legs 102, front legs 104, backrest 106, lid 110, base 112, toilet seat 118, and retaining ring 122, can be replaced with new parts. Similarly, it may be desirable to upgrade some of the parts of the chair 100. As such, the parts of the chair 100 can be removed and replaced with upgraded parts. For example, it may be desirable to upgrade the toilet seat 118 to a toilet seat 118 having gel or cushioning. In another example, it may be desirable to upgrade the back rest portion 106 to a back rest portion 106 having a solar panel, portable charging capabilities, or the like.

Figure 6A:
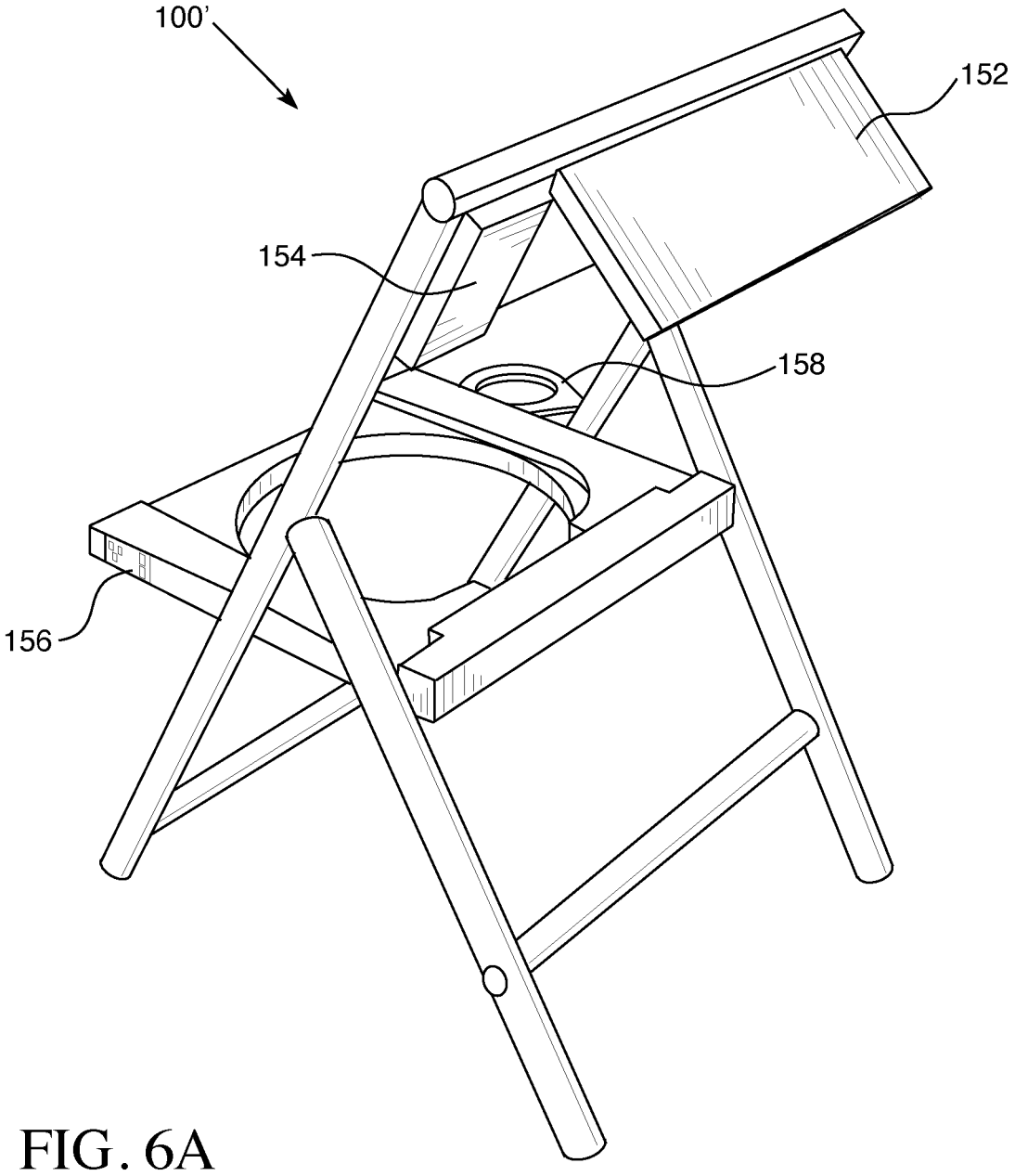
FIG. 6A is a perspective view of a multipurpose folding chair that includes additional optional features, in accordance with one embodiment of the present invention.
Figure 6B:
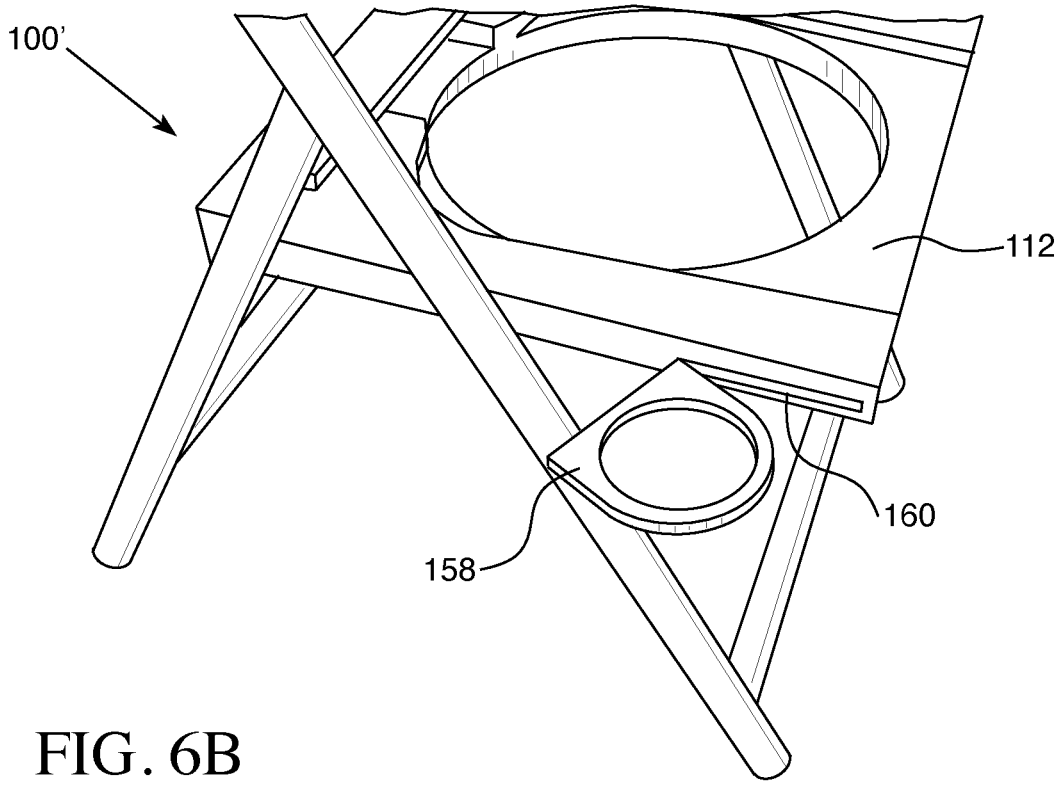
FIG. 6B is a close up view of a multipurpose folding chair having a cup holder, in accordance with one embodiment of the present invention.
Figure 6C:
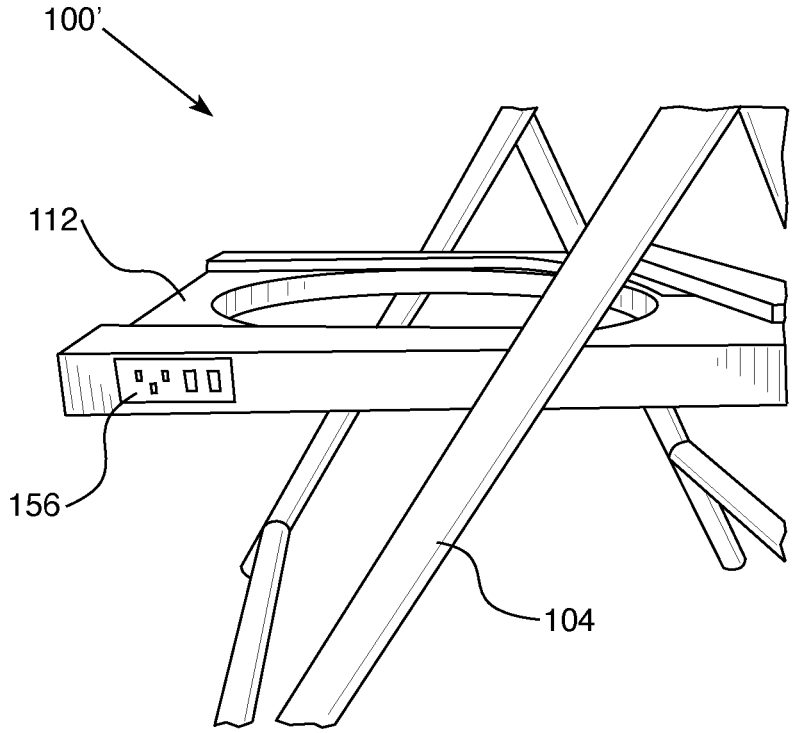
FIG. 6C is a close up view of a multipurpose folding chair having an electrical outlet, in accordance with one embodiment of the present invention.

An upgraded chair 100' is depicted in FIGS. 6A-6C. The upgraded chair 100' may include a solar panel 152, a voltage regulator 154, an electrical outlet 156, and/or a cup holder 158. The electrical outlet 156 is coupled to the solar panel 152 through the voltage regulator 154. As such, a user may additionally use the chair 100' as a power source. For example, the chair 100' may be used to charge portable electronic devices.

The cup holder 158 is shown in more detail in FIG. 6B. The base 112 of the chair 100' may include a slot 160 in which the cup holder 158 may be stored. The cup holder 158 may have a storage position in which the cup holder 158 is positioned within the slot 160, and may have an extended position in which the cup holder 158 extends out of the slot 160. The extended position is shown in FIG. 6B.

The electrical outlet 156 is shown in more detail in FIG. 6C. The electrical outlet 156 is built into the side of the base 112 of the chair 100'. Connecting wires between the electrical outlet 156 and the solar panel 152 may be disposed inside the base 112, the front legs 104, and the backrest 106 portions of the chair 100'.

Figure 7:
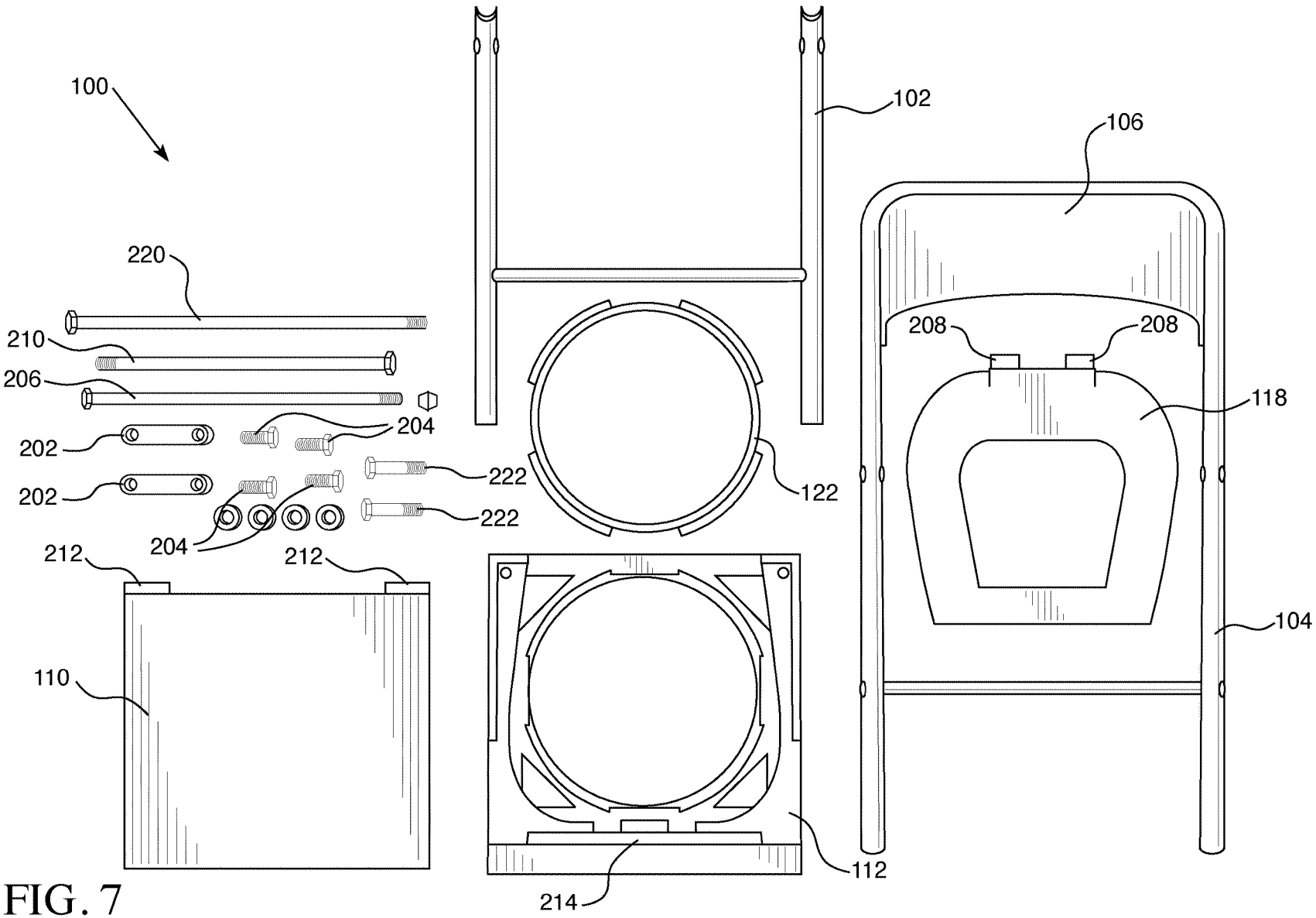
FIG. 7 is a plan view of a multipurpose folding chair in a disassembled state, in accordance with one embodiment of the present invention.

As shown in FIG. 7, the chair 100 is made of a few simple pieces that are easily assembled and disassembled so that pieces of the chair 100 can easily be replaced. In particular, the chair 100 includes back legs 102, a unitary piece that includes the front legs 104 and the back rest 106, the base 112 of the seating portion, the toilet seat 118, retaining ring 122, and lid 110. In order to assemble the chair 100, the front legs 104 are attached to the back legs 102 using hinges 202 and bolts 204, as shown in FIG. 4. In contrast, the front legs and rear legs of a conventional folding chair are typically permanently coupled together by riveting the hinges to the legs.

The toilet seat 118 is hingedly coupled to the base 112 using a long, partially threaded hex bolt 206 that passes through openings 208 in the rear portion of the toilet seat 118 and through openings (not shown) in the rear portion of the base 112. The openings 208 in the toilet seat are positioned adjacent to the opening in the base 112 and the bolt 206 passes through all the openings. The inner diameter of the toilet seat openings 208 is larger than the outer diameter of the long bolt 206 so that the toilet seat 118 can rotate around the longitudinal axis of the bolt 206.

Similarly, the lid 110 is coupled to the base 112 with long, partially threaded bolt 210 that passes through openings 212 in the lid 110 and through the lumen of an elongate tubular member 214 on the base 112. The inner diameter of the openings 212 in the lid 110 is larger than the outer diameter of the bolt 210 so that the lid 110 can rotate relative to the longitudinal axis of the bolt 210. The base 112 is coupled to the rear legs 102 using an elongate, partially threaded bolt 220 and is coupled to the front legs 104 using smaller bolts 222. The base 112 is configured to rotate relative to the bolts 220, 222.

Due to the simple construction, the chair 100 can easily be disassembled by a user having basic knowledge of how to use a threaded bolt. If parts become damaged, or if a user desires to upgrade one or more of the parts, the chair 100 can easily be disassembled and then reassembled with the new or upgraded parts. In another example, the lid 110, base 112, toilet seat 118, retaining ring 122, and associated hardware may be provided in a kit that can be used to modify a conventional folding chair. That is, the kit may include the lid 110, base 112, toilet seat 118, retaining ring 122, elongated hex bolts 206, 210, 220, bolts 204, 222, and hinges 202.

Additional Considerations

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Some embodiments may be described using the expression "coupled" and "connected" along with their derivatives. For example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments are not limited in this context.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the invention. This description should be read to include one or at least one and the singular also includes the plural unless it is obvious that it is meant otherwise.

Upon reading this disclosure, those of skill in the art will appreciate still additional alternative structural and functional designs for a system and a process for creating an interactive message through the disclosed principles herein. Thus, while particular embodiments and applications have been illustrated and described, it is to be understood that the disclosed embodiments are not limited to the precise construction and components disclosed herein. Various apparent modifications, changes and variations may be made in the arrangement, operation and details of the method and apparatus disclosed herein without departing from the spirit and scope defined in the appended claims.

What is claimed is:

1. A multipurpose folding chair comprising:

back legs;

front legs pivotably coupled to the back legs;

a collapsed configuration in which the back legs and front legs are parallel and directly adjacent to each other;

an open configuration in which the back legs and front legs are spaced apart and are at an acute angle relative to each other; and a seating portion pivotably coupled to the back legs and the front legs, wherein the seating portion is substantially horizontal and parallel to the ground when the chair is in the open configuration, and wherein the seating portion comprises:

a base portion pivotably coupled to the back legs and the front legs, wherein the base portion comprises a frame and a through opening in a central portion of the frame;

a lid hingedly coupled to the base portion such that the lid is configured to open relative to the base portion, wherein the lid comprises a solid upper surface that is sized and shaped for a user to sit on;

a toilet seat hingedly coupled to the base portion such that the toilet seat is configured to hinge open relative to the base portion, wherein the toilet seat comprises an aperture that is aligned with the through opening in the base portion, and wherein the lid covers the toilet seat; and a retaining ring that fits snugly within the through opening in the base portion, wherein the retaining ring is configured to hold a waste receptacle securely to the chair, such that waste that is disposed through the toilet seat aperture is captured in the waste receptacle.

2. The multipurpose folding chair of claim 1, wherein the retaining ring comprises a downwardly protruding portion and a circumferential lip extending substantially perpendicularly outwards relative to the downwardly protruding portion.

3. The multipurpose folding chair of claim 2, wherein the downwardly protruding portion of the retaining ring has an outer diameter that is slightly less than an inner diameter of the through opening in the base portion, such that the downwardly protruding portion fits within the through opening.

4. The multipurpose folding chair of claim 3, wherein the through opening in the base portion further comprises a ledge that extends around the circumference of the through opening and the circumferential lip of the retaining ring is configured to rest on the ledge when the retaining ring is disposed within the through opening.

5. The multipurpose folding chair of claim 1, further including a back rest.

6. The multipurpose folding chair of claim 5, wherein the back rest and the front legs are made of a unitary piece.

7. The multipurpose folding chair of claim 1, further comprising an electrical outlet coupled to a solar panel, wherein the electrical outlet is built into the seating portion.

8. The multipurpose folding chair of claim 1, wherein the toilet seat is hingedly coupled to the base portion using an elongate, partially threaded bolt.

9. The multipurpose folding chair of claim 1, wherein the lid is hingedly coupled to the base portion using an elongate, partially threaded bolt.

10. A kit for modifying a conventional folding chair, wherein the kit comprises:

a base portion comprising a frame and a through opening in a central portion of the frame;

a lid hingedly coupled to the base portion such that the lid is configured to open relative to the base portion, wherein the lid comprises a solid upper surface that is sized and shaped for a user to sit on;

a toilet seat hingedly coupled to the base portion such that the toilet seat is configured to hinge open relative to the base portion, wherein the toilet seat comprises an aperture that is aligned with the through opening in the base portion, and wherein the lid covers the toilet seat; and a retaining ring that fits snugly within the through opening in the base portion, wherein the retaining ring is configured to hold a waste receptable, such that waste that is disposed through the toilet seat aperture is captured in the waste receptacle.

11. The kit of claim 10, wherein the lid is hingedly coupled to the base portion with an elongate, partially threaded hex bolt.

12. The kit of claim 10, wherein the toilet seat is hingedly coupled to the base portion with an elongate, partially threaded hex bolt.

13. The kit of claim 10, further comprising bolts configured for attaching the base portion to a front leg piece and a rear leg piece of the conventional folding chair.

* * * * *